US005092499A

United States Patent [19]

Sodderland

[11] Patent Number: 5,092,499

[45] Date of Patent: Mar. 3, 1992

[54] DELIVERY MEANS FOR CONVEYING A FIXED CHARGE OF MOLTEN METAL TO A MOLD CAVITY OF A DIE-CASTING MACHINE

[76] Inventor: George A. Sodderland, 117 Maintoulin Drive, London, Ontario, Canada, N5W 1M5

[21] Appl. No.: 616,660

[22] Filed: Nov. 20, 1990

[30] Foreign Application Priority Data

Jan. 31, 1990 [CA] Canada ..... 2008990

[51] Int. Cl.[5] ..... B67D 1/10

[52] U.S. Cl. ..... 222/596; 266/239

[58] Field of Search ..... 222/591, 597, 596; 266/239; 164/312, 313, 314, 315

[56] References Cited

U.S. PATENT DOCUMENTS

| | | | |
|---|---|---|---|
| 2,058,378 | 10/1936 | Freund | 266/239 |
| 2,224,978 | 12/1940 | Morin | 266/239 |
| 2,224,981 | 12/1940 | Morin | 164/312 |
| 2,609,575 | 9/1952 | Morin | 222/596 |
| 3,469,621 | 9/1969 | Fulgenzi | 222/596 |
| 3,618,831 | 11/1971 | Goodwin et al. | 164/312 |
| 3,652,073 | 3/1972 | Lewis | 266/239 |
| 4,078,706 | 3/1978 | Hanuszczak | 222/596 |
| 4,593,741 | 6/1986 | Caughtery | 164/312 |

*Primary Examiner*—S. Kastler
*Attorney, Agent, or Firm*—Mitches & Co.

[57] ABSTRACT

This invention relates to a delivery assembly for delivering molten metal, to a die-casting machine. The system includes a die-casting liquid metal injector with an operative piston having a cylindrical shuttle valve within the assembly and providing for a lower end portion of the assembly to communicate directly to a reservoir of molten metal, particularly corrosive molten metal such as liquid aluminum or the like. In that respect, the injector surface having contact with the corrosive liquid metal are preferably made of a fine ceramic or composite thereof and in the preferred embodiment by partially stabilized Zirconia. The piston, during its molten metal charging stroke, moves the shuttle away from closing off the inflow conduit which communicates to the liquid metal reservoir supply and the internal cavity defined by the assembly is charged with liquid metal. On the compressive stroke of the piston, the shuttle first moves forward to close off the inflow channel insuring no leakage of molten metal back to the supply reservoir and at the same time, the metal within the piston chamber now communicates with an outflow orifice directly to a nozzle which injects liquid metal directly into a mold cavity. A fixed charge for the cavity is achieved.

27 Claims, 2 Drawing Sheets

DELIVERY MEANS FOR CONVEYING A FIXED CHARGE OF MOLTEN METAL TO A MOLD CAVITY OF A DIE-CASTING MACHINE

BACKGROUND OF THE INVENTION

This invention relates to a delivery system for delivering molten metal to a molding cavity of a die-casting machine. Particularly, the delivery means or assembly features a gooseneck shaped molten metal delivery channel communicating to an injector and valve assembly within a housing, the latter immersed in a molten metal reservoir, and adapted to deliver, preferably a fixed charge, of molten metal directly to a mold cavity of a die-casting machine.

In conventional mold die-casting machines that die-cast miniature to medium sized parts, the molten metal delivery devices for conveying molten casting material to the mold cavity are generally shaped as a gooseneck. Such liquid molten delivery systems are particularly popular for delivering zinc from a reservoir furnace of molten metal to the die cavity where the casting operation takes place. Such gooseneck assemblies have typically relied on the co-operative arrangement of positioning the molten metal intake, and delivery port in relative co-operation with a piston to regulate the actual metal flowing through both ports, while the intake port communicates to the molten metal reservoir, and the delivery port directly to the mold or to a delivery channel communicating directly to the cavity of the mold. Such arrangements, particularly in non-corrosive metal applications such as molten zinc, have had the undesirable feature of allowing air to enter the molten metal intake conduit, particularly during the intake stroke of the piston; that is, the stroke which pulls metal from the molten reservoir into the delivery system. The air is thus entrained in the liquid metal in the delivery system. Prior art results of such air flows include bubbles impregnated within the finished casting or pitted cast surfaces. Further, wear on the molten metal flowing piston, which is the operative element for flowing the liquid metal, has been severe because the operative piston stroke was of necessity relatively long, thus increasing the tendency of wear on the piston; or, imposing constrictions on the fabrication of the piston and piston chamber, resulting in surfaces thereon being less than optimally smooth.

Prior art assemblies have attempted to overcome such deficiencies with improved gooseneck-type assemblies which incorporate therein a ball-valve structure similar to that described in Canadian Patent 802,100 issued 24 Dec., 1968 to Dynacast Limited. Modified goosenecks according to this structure lowered the amount of air admitted into the piston chamber; nevertheless, undesired drainage of molten metal from the piston chamber back into the molten metal reservoir occurred during the compression stroke of the piston. A major consequence of such structure in prior art systems was that drainage of molten metal occurred from the delivery piston chamber back into the molten liquid supply reservoir, but most importantly, this caused less than a "full charge" of molten metal being injected, from the delivery piston chamber into the mold cavity. Additionally, with heat and pressure losses, casting speeds and casting qualities have been substantially reduced from that which are theoretically possible. Prior art structures, though operative at a less than optimal speed and quality, fail as an accepted delivery system for corrosive molten metals such as aluminum, titanium and the like, since they corrode the operative components of the delivery system.

SUMMARY OF THE INVENTION

The present invention contemplates a novel delivery system for molten metal, particularly corrosive molten metal such as aluminum, and employs a molten metal delivering system which is submerged in a molten metal reservoir and thus to retain the temperature of the liquid metal, at the liquid flow temperature pending delivery to the mold cavity. In this reservoir , the system has its output channel, extending out of the reservoir in a fashion for delivering a heated fixed charge of molten metal through an output nozzle directly into the receiving cavity of a die-casting machine. Such system preferably has housing walls and components, that are in direct contact with the corrosive molten metal, fabricated from a ceramic, or ceramic composite ,or a partially stabilized Zirconia as available from NILCRA CERAMICS PTY. LTD. of Victoria Australia. Specifically contemplated is a chamber defined by a bore in a ceramic housing making communication with the molten metal reservoir at an elevation below the metal delivery or output channel, and a passive shuttle within the bore that is adapted to move up and down, within the bore. There is additionally provided a lower bevelled face in the bore which when the shuttle is in its lowest extremity seals off the inflow port into the chamber. As the shuttle moves to and fro within the bore, in response to the reciprocation of the piston, which, on the input stroke, draws in molten metal from the supply reservoir through the input port while first causing the shuttle to move away from and to open said input port yet on the compressive and delivery stroke of the piston, first moves the shuttle to close off the input port thus causing a "full charge" to be contained within the delivery chamber, that on completion of the compression stroke, conveyed completely through the communicating outflow channel and nozzle into the cavity. In this fashion, no leakage nor backflow of molten metal from the chamber into the molten metal reservoir takes place as has been conventional with prior art devices. Additionally with judicial selection of, the cross-sectional area of the cylindrical chamber; the piston stroke; and, the cross-sectional flow area through the shuttle high speed charging sequences approaching 6,000 cycles per hour (100 per minute) are reasonably achievable.

BRIEF DESCRIPTION OF THE DRAWINGS

The invention will now be described by way of example and reference to the accompanying drawings in which.

DETAILED DESCRIPTION OF THE INVENTION

Figure 1:
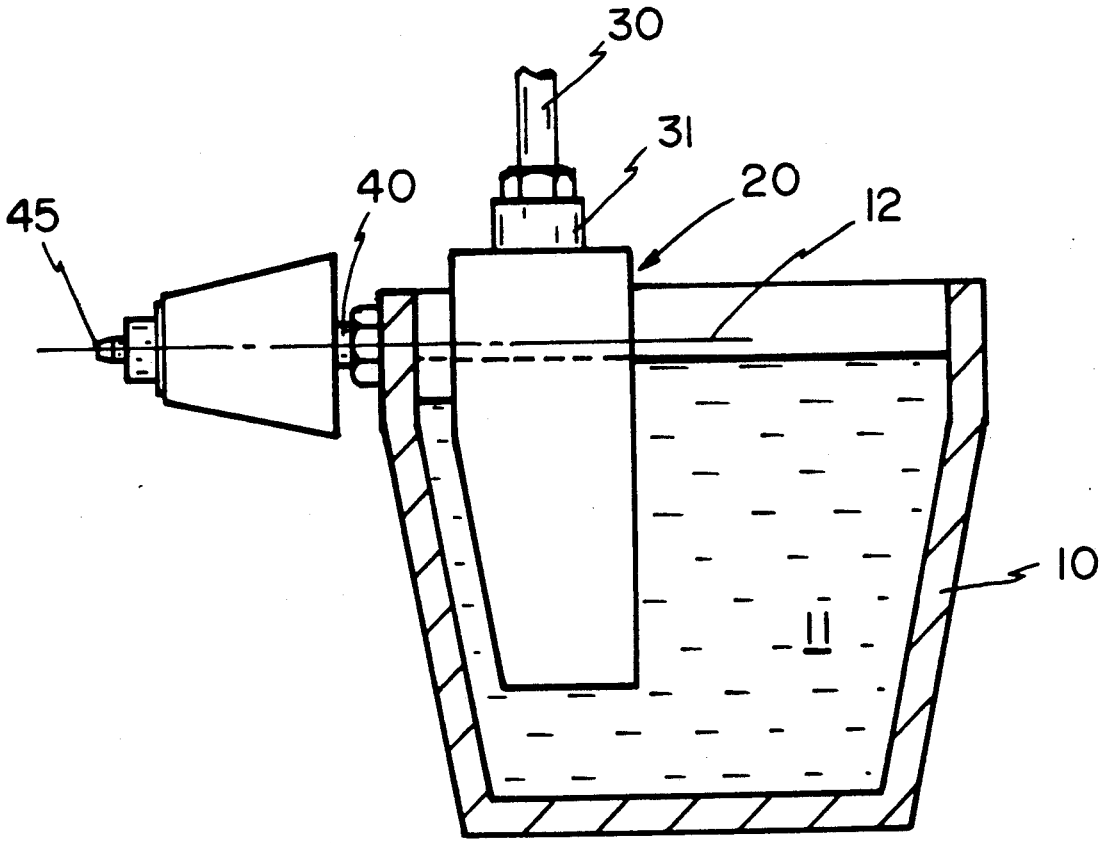
FIG. 1 is a diagramatic elevational view of the delivery system, according to the invention, immersed in a molten metal reservoir.

Referring to FIG. 1, a reservoir 10 contains molten metal 11 and when that metal is corrosive such as aluminum and the like, the surface 12 of the metal is exposed to nitrogen or other inert gas so as to prevent oxygen from making contact therewith and oxidizing the molten metal 11. The molten metal delivery system, according to the invention, is generally shown as 20 and consists of a lower housing member 21 and an upper member or housing cap 22. Not shown is the fact that the housing cap 22 and lower housing member 21 are maintained closed by screws, flanges and other devices.

Figure 2:
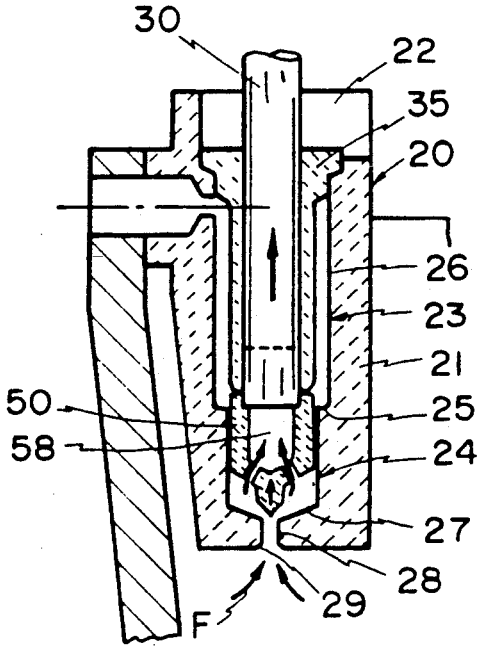
FIGS. 2 through 5 are elevational cross-sections of the shuttle chamber and valve assembly of the delivery system according to FIG. 1 during its several phases for charging, the cylinder on the intake stroke, and discharging a measured charge to the moulding cavity on the discharge stroke.

The housing member 21 defines therein a chamber shaped as a step bore generally shown as 23 having a lower minor bore 24 that communicates through a step 25 into an upper major bore 26. The lower bore 24 is profiled at the bottom thereof into a truncated conical step 27 whose lowest extremity defines a molten metal inflow channel 28 with exterior intake orifice 29. The molten metal flows in the direction of the arrows F, shown in FIG. 2, during the charging stroke of a reciprocating piston 30. The piston 30 has its rod extending through a bushing cap and seal 31 mounted in the housing cap 22, as seen in FIG. 2. The upper margin of the major bore 26 has a step 29 therein and into this step seats a depending cylindrical piston receiving sleeve 35 which transcends for most of its length as a uniform cylindrical sleeve to terminate at an annular bottom 36. The cylindrical sleeve 35 is of fixed length and defines a uniform cylindrical chamber 37 sized to the diameter of the reciprocating piston 30 and partitions the upper bore 26 into a circumferential annular molten metal holding region 38, which at its upper extremity, along one margin, communicates through aperture 39 to molten metal outflow channel 40 which communicates further to the outflow nozzle 45, see FIG. 1, which makes direct communication to a cavity of a die-casting machine, not shown.

Figure 3:
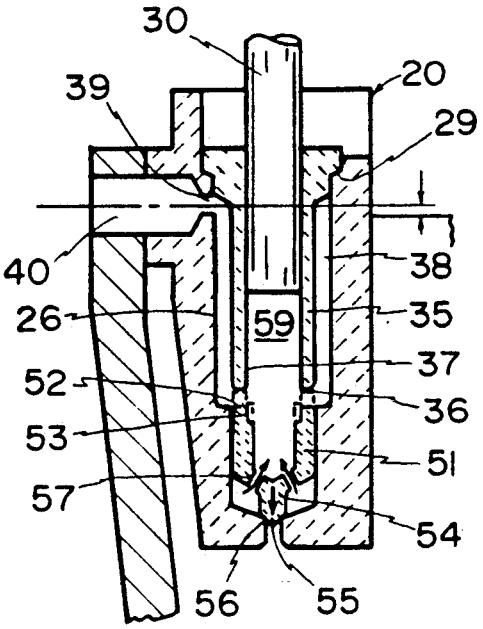
Figure 4:
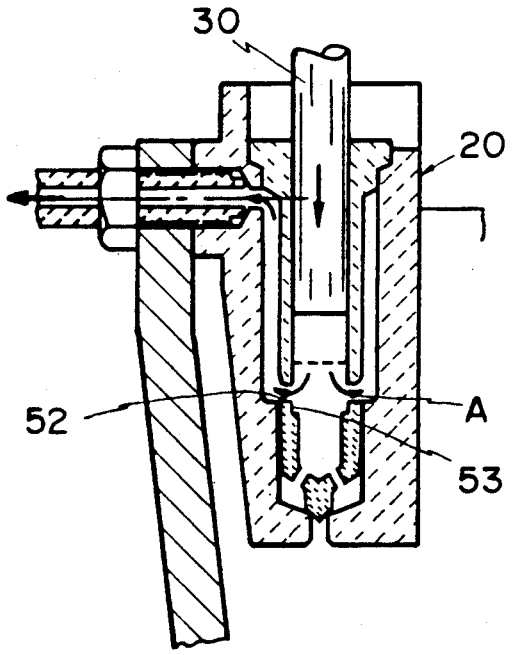
Figure 5:
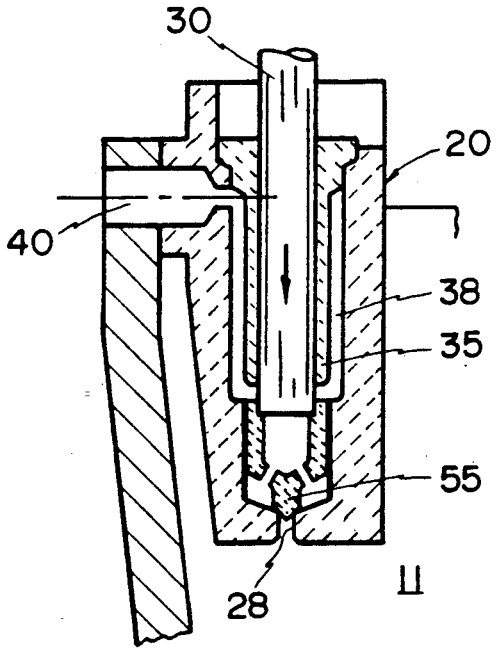

The minor bore 24 is provided with a shuttle 50 that is formed as an open ended cylindrical portion 51 whose upper annular margin 52 is provided with an annular step 53 and whose inner diameter is sized to the outer diameter of the piston 30. The shuttle 50 otherwise has an uniform inner diameter that defines an inner plenum 58 and at its lower extremity or end, forms a conical shoulder 54 with a protruding or depending cylindrical valve stem 55 whose distal outer surface 56 is conical and sized to seat against and to close off the inflow channel 28 during the piston compression stroke, as seen in FIGS. 4 and 5. The shuttle 50 has a plurality of apertures 57 defined by the conical shoulder 54 that permits molten metal flow F, during intake stroke of piston 30, see FIGS. 2 and 3, so as to allow molten metal to enter the interior region 58. The effective cross-sectional area of the aperture 57 is less than the cross-sectional area of the sleeve or of the inner region 58.

In operation, and referring to FIGS. 2 through 5, at the dead end of the compression stroke, FIG. 5, the piston 30 is in its lowest extension and is nested into the annulus 54 on the upper inside lip of the shuttle 50, and the shuttle tip 55 seals off the inflow channel 28 to the molten metal reservoir.

During the initial stages of the intake stroke, FIG. 2, the shuttle 50 is moved away from sealing engagement with the intake orifice 28 until the upper annulus 52 of the shuttle 50 makes contact with the lower annulus 36 of the inner cylindrical member 35, whereupon the shuttle movement stops though the piston continues its upward movement, as shown in FIG. 2, to charge the spaces 58 and 59 respectively defined by the interior of the shuttle 50 as piston 30 and cylindrical sleeve 35. Depending upon the volume of "charge" required, the piston will eventually stop, FIG. 3, and will begin thereafter its compression stroke whereupon the shuttle 50, see FIG. 4, descends downward to close off the inflow port 28, as shown, whereupon the metal within regions 58 and 59 is flowed between the space defined by annuli 36 and 52 (as shown in the arrow A of FIG. 4) and the flow of molten metal continues through annular region 38 and out the output port 39 into the output delivery channel 40 for conveyance to the nozzle 45 and the cavity. The last initial movement of the piston 30 during its compression stroke, FIG. 5, seats the piston 30 into the annular recess 53 of the shuttle 50 and the "fixed charge" of molten metal has been delivered. At the same time, by seating in the annular recess 53, the annular chamber 38 is sealed off from the inner plenum 58 of the shuttle 50. The cycle can be repeated.

In order to get proper vacuum during the intake stroke, it is preferred that the effective cross-sectional area of the apertures 57 be less than the internal cross-sectional area of the sleeve or the bore 37 thereof and smaller in area than the plenum 58 of the shuttle.

I claim:

1. A molten metal delivery assembly comprising:

an injector housing;

a chamber in said housing communicating with an inlet conduit for delivering a supply of molten metal into the chamber and also communicating with an output conduit for supplying molten metal from the chamber into an injection nozzle;

a piston-receiving sleeve secured to said housing in said chamber;

a piston mounted for reciprocal motion in the sleeve, the interior of the lower portion of the sleeve being open to the chamber when the piston is beginning its compressive stroke; and, a dual purpose shuttle valve communicating with the chamber and operative on the compressive stroke of the piston to close the inlet conduit and open the output conduit and on the return stroke of the piston to open the inlet conduit and to close the output conduit;

wherein during operation, the shuttle valve on the return stroke of the piston defines an intake channel into the chamber, said intake channel constituting the flow path from the inlet conduit to the chamber.

2. An assembly as claimed in claim 1 wherein said valve presents a working surface area to molten metal entering the chamber from the inlet conduit, the surface area and the inlet conduit cross section each being larger relative to the cross sectional area of the intake channel generally perpendicular to the flow path.

3. An assembly as claimed in claim 1 wherein the flow of molten metal is more restricted through the intake channel than the flow of molten metal is through the output conduit.

4. An assembly as claimed in claim 1 wherein the output conduit has a cross sectional area perpendicular to the flow path which is larger relative to the cross sectional area of the intake channel perpendicular to the flow path.

5. An assembly as claimed in claim 1 wherein the valve is a shuttle valve mounted for free reciprocating motion between a first extreme position and a second extreme position in a valve-receiving sleeve, the interior of which communicates with the inlet conduit and the chamber, the sleeve terminating at one end adjacent the inlet conduit in a valve seat sealingly engageable by a mating face of the shuttle valve, which face presents the said working surface area to incoming molten metal from the inlet conduit, the valve intervening between the output conduit and the inlet conduit thereby to close off the output conduit from the inlet conduit in the first extreme position thereof, and the face of the valve engaging the valve seat in the second extreme position thereof, thereby closing the inlet conduit, the valve occupying the first extreme position on the return stroke of the piston and occupying the second extreme position on the compressive stroke of the piston.

6. An assembly as claimed in claim 5 wherein the valve comprises a piston-receiving cylinder open at one end thereof communicating with the chamber and closed over the surface of the other end defining said face, and provided with at least one aperture defining the intake channel, the aperture communicating between the hollow interior of the valve and the interior of the sleeve adjacent the valve seat, whereby during operation of the assembly, upon the lowermost portion of the compressive stroke of the piston, said piston enters said cylinder, and upon the beginning of return stroke of the piston, said valve, following the upward movement of the piston, moves to said first extreme position.

7. An assembly as claimed in claim 1 wherein the piston is located above the valve for most of its stroke but comes into closer proximity with the valve at the lowermost portion of its stroke, whereby when the piston begins its upward return stroke, the piston tends to draw the valve upwards with the piston.

8. An assembly as claimed in claim 2 wherein the piston is located above the valve for most of its stroke but comes into closer proximity with the valve at the lowermost portion of its stroke, whereby when the piston begins its upward return stroke, the piston tends to draw the valve upwards with the piston.

9. An assembly as claimed in claim 3 wherein the piston is located above the valve for most of its stroke but comes into closer proximity with the valve at the lowermost portion of its stroke, whereby when the piston begins its upward return stroke, the piston tends to draw the valve upwards with the piston.

10. An assembly as claimed in claim 1 wherein the sleeve is secured to the housing.

11. An assembly as claimed in claim 2 wherein the sleeve is secured to the housing.

12. An assembly as claimed in claim 3 wherein the sleeve is secured to the housing.

13. The assembly as claimed in claim 1 wherein the chamber defines a two step bore, and the piston receiving sleeve is sized with an outer bore smaller than the major bore and the shuttle is adapted to juxtaposition against the distal end of the sleeve during the return stroke of the piston and charging of the piston chamber by molten metal.

14. The assembly as claimed in claim 2 wherein the chamber defines a two step bore, and the piston receiving sleeve is sized with an outer bore smaller than the major bore and the shuttle is adapted to juxtaposition against the distal end of the sleeve during the return stroke of the piston and charging of the piston chamber by molten metal.

15. The assembly as claimed in claim 3 wherein the chamber defines a two step bore, and the piston receiving sleeve is sized with an outer bore smaller than the major bore and the shuttle is adapted to juxtaposition against the distal end of the sleeve during the return stroke of the piston and charging of the piston chamber by molten metal.

16. The delivery assembly as claimed in claim 1 wherein the internal chamber walls, piston receiving sleeve, piston, and shuttle as well as inlet and outlet conduits are composed of ceramic or ceramic composite materials.

17. The delivery assembly as claimed in claim 2 wherein the internal chamber walls, piston receiving sleeve, piston, and shuttle as well as inlet and outlet conduits are composed of ceramic or ceramic composite materials.

18. The delivery assembly as claimed in claim 3 wherein the internal chamber walls, piston receiving sleeve, piston, and shuttle as well as inlet and outlet conduits are composed of ceramic or ceramic composite materials.

19. The delivery assembly as claimed in claim 4 wherein the internal chamber walls, piston receiving sleeve, piston, and shuttle as well as inlet and outlet conduits are composed of ceramic or ceramic composite materials.

20. The delivery assembly as claimed in claim 5 wherein the internal chamber walls, piston receiving sleeve, piston, and shuttle as well as inlet and outlet conduits are composed of ceramic or ceramic composite materials.

21. The delivery assembly as claimed in claim 6 wherein the internal chamber walls, piston receiving sleeve, piston, and shuttle as well as inlet and outlet conduits are composed of ceramic or ceramic composite materials.

22. An assembly as claimed in claim 1 wherein the piston is located above the valve for most of its stroke but comes into close proximity with the valve at the lowermost portion of its stroke, so when the piston begins its upward return stroke, the piston tends to draw the valve upwards with the piston and wherein the internal chamber walls, piston receiving sleeve, piston, and shuttle as well as inlet and outlet conduits are composed of a material selected from a ceramic, a ceramic composite, or partially stabilized Zirconia.

23. An assembly as claimed in claim 2 wherein the piston is located above the valve for most of its stroke but comes into close proximity with the valve at the lowermost portion of its stroke, so when the piston begins its upward return stroke, the piston tends to draw the valve upwards with the piston and wherein the internal chamber walls, piston receiving sleeve, piston, and shuttle as well as inlet and outlet conduits are composed of a material selected from a ceramic, a ceramic composite, or partially stabilized Zirconia.

24. An assembly as claimed in claim 3 wherein the piston is located above the valve for most of its stroke but comes into close proximity with the valve at the lowermost portion of its stroke, so when the piston begins its upward return stroke, the piston tends to draw the valve upwards with the piston and wherein the internal chamber walls, piston receiving sleeve, piston, and shuttle as well as inlet and outlet conduits are composed of a material selected from a ceramic, a ceramic composite, or partially stabilized Zirconia.

25. An assembly as claimed in claim 1 wherein the sleeve is secured to the housing wherein the internal chamber walls, piston receiving sleeve, piston, and shuttle as well as inlet and outlet conduits are composed of a material selected from a ceramic, a ceramic composite, or partially stablized Zirconia.

26. An assembly as claimed in claim 2 wherein the sleeve is secured to the housing wherein the internal chamber walls, piston receiving sleeve, piston, and shuttle as well as inlet and outlet conduits are composed of a material selected from a ceramic, a ceramic composite, or partially stablized Zirconia.

27. An assembly as claimed in claim 3 wherein the sleeve is secured to the housing wherein the internal chamber walls, piston receiving sleeve, piston, and shuttle as well as inlet and outlet conduits are composed of a material selected from a ceramic, a ceramic composite, or partially stablized Zirconia.

* * * * *